US006867547B2

(12) United States Patent
Dünisch

(10) Patent No.: US 6,867,547 B2
(45) Date of Patent: Mar. 15, 2005

(54) FLASH LAMP AND FLASH LAMP STRUCTURE

(75) Inventor: Ingo Dünisch, Wiesbaden (DE)

(73) Assignee: Perkinelmer Optoelectronics GmbH, Wiesbaden (DE)

( * ) Notice: Subject to any disclaimer, the term of this patent is extended or adjusted under 35 U.S.C. 154(b) by 0 days.

(21) Appl. No.: 10/344,433

(22) PCT Filed: Aug. 9, 2001

(86) PCT No.: PCT/EP01/09226

§ 371 (c)(1),
(2), (4) Date: Aug. 6, 2003

(87) PCT Pub. No.: WO02/15213

PCT Pub. Date: Feb. 21, 2002

(65) Prior Publication Data

US 2004/0032218 A1 Feb. 19, 2004

(30) Foreign Application Priority Data

Aug. 11, 2000 (DE) ..... 100 39 383

(51) Int. Cl.[7] ..... H01J 17/44
(52) U.S. Cl. ..... 313/594; 313/234; 313/607
(58) Field of Search ..... 313/594, 607, 313/234; 315/241 P

(56) References Cited

U.S. PATENT DOCUMENTS

| | | | | |
|---|---|---|---|---|
| 3,733,599 A | * | 5/1973 | Fantozzi | 315/241 S |
| 3,860,853 A | | 1/1975 | Ludloff | 315/178 |
| 4,004,189 A | * | 1/1977 | Cosco et al. | 315/335 |
| 4,156,890 A | | 5/1979 | Hebert et al. | 362/16 |
| 4,550,275 A | | 10/1985 | O'Loughlin | 315/241 R |
| 4,897,572 A | | 1/1990 | Plofchan | 313/146 |
| 5,170,091 A | | 12/1992 | Wekhof | 313/163 |
| 5,945,790 A | | 8/1999 | Schaefer | 315/335 |
| 6,008,583 A | | 12/1999 | Breuer et al. | 313/594 |
| 6,087,783 A | | 7/2000 | Eastlund et al. | 315/246 |

FOREIGN PATENT DOCUMENTS

| | | |
|---|---|---|
| DE | PS 1 204 746 | 11/1965 |
| DE | 1 948 399 | 8/1966 |
| DE | 2 120 777 | 11/1972 |
| DE | OS 2 248 132 | 4/1973 |
| DE | 2 210 948 | 9/1973 |
| DE | OS 2 222 365 | 11/1973 |
| DE | 22 64 377 B2 | 3/1975 |
| DE | 25 08 008 A1 | 9/1976 |
| DE | 33 36 421 A1 | 5/1984 |
| DE | 41 41 675 A1 | 7/1992 |
| EP | 0 371 164 A1 | 11/1988 |
| FR | 2 599 890 A1 | 6/1986 |

OTHER PUBLICATIONS

Abstract, JP2001185088, XP002191319, Database WPI, Section EI, Week 200153, Jul. 6, 2001, Derwent Publications Ltd., London, GB (1 page).
Partial Search Report, PCT/EP01/09226 (4 pages).
International Search Report, PCT/EP01/09226 (10 pages).

* cited by examiner

*Primary Examiner*—David Vu
(74) *Attorney, Agent, or Firm*—Wood, Herron & Evans, LLP

(57) ABSTRACT

A flash lamp (10), comprising a gas-filled discharge tube (10) made of glass and, at each end, a power electrode (14, 15) that is sealed by means of a glass solder (13), has a glass including one or more of the following U.V. transmission values Tw: at 180 nm: Tw>5%, preferably >9 %; at 200 nm: Tw>30%, preferably >45%; at 254 nm: Tw>60%, preferably >80%. The inside diameter of the discharge tube (11) may be larger than 1.2 times the value of the plasma channel diameter. The starting electrode (16) may be part of the reflector (30-33) or be connected electrically thereto. Flash capacitor (42) may be designed for a charging voltage above 370 volts, preferably above 400 volts.

25 Claims, 3 Drawing Sheets

FLASH LAMP AND FLASH LAMP STRUCTURE

The invention relates to a flash lamp and a flash lamp design. In particular, it concerns flash lamps for applications within the U.V. region (wavelength <450 nm).

FIG. 5A shows a general design of a flash lamp 50. The latter comprises a self-contained glass body 53 containing a gas, e.g. xenon, under a certain filling pressure. The tubular body 53 has electrodes 51 at both ends. As a result of the thermal resistivity, these electrodes are made of tungsten, at least in the area within the tube. The direct voltage of a flash capacitor, usually about 300 to 350 volts, is available at the electrodes. This voltage alone does not suffice to cause a discharge which will rather only result if another starting voltage is applied capacitively via a starting electrode 52 (1000 volts alternating voltage or more). This starting voltage then triggers the start of discharge, the discharge continuing even if the starting voltage at starting electrode 52 has disappeared again. The electrodes 51 are sealed into the glass body 53 by means of glass collars 54.

FIG. 5B shows a cross-section of a flash lamp 50 in connection with a reflector 55 in a known design. The reflector may be a parabolic reflector straightening the light emitted all around by the flash lamp substantially in one direction. The flash lamp 50 may abut against the reflector 55. The reflector may be a sheet which is used as a starting electrode, is correspondingly integrated into the electric wiring and held in insulated fashion.

In particular with respect to U.V. applications, known flash lamps involve various problems:

Conventionally used glasses have a poor U.V. transmission. This means that although U.V. light is perfectly produced within flash lamp 50, it is already absorbed within the glass thus failing to reach the outside. Conventional flash lamps are made in particular of tempered boron silicate glass because the latter permits to use a particularly economical sealing technique for the electrodes. However, at a thickness of 0.5 mm such a tempered glass is no longer adequately transmitting for wavelengths of 320 nm and shorter so that it is not suited for U.V. applications.

In fact there are certain glasses having an improved U.V. transmission. Quartz glasses have a high melting point, thus requiring an expensive and time-consuming manufacturing process which is only justified in the case of flash lamps having a high flash energy (>100 Ws). However, this process cannot be used for flash lamps for U.V. applications with low flash energy (<100 Ws) since this would not be economical.

Another problem of known flash lamps is the blackening of the glass wall. During a discharge, the electrodes in the flash tube evaporate to a certain extent. The metal vapor deposits on the inside walls of glass tube 53. As a result, the transmission of the glass body is further impaired, in particular for U.V. light. As far as designs according to FIG. 5B are concerned it has turned out that the deposit of the evaporated tungsten material is increased in a certain way in the area where reflector 55 and glass tube 53 contact. However, an extensive distribution of the deposit over the inner surface of the glass tube is observed here as well.

Finally, the known reflector designs according to FIG. 5B have the drawback that multiple reflections occur between flash lamp 50 and reflector 55, which reduces the light efficiency because of repeated absorption, on the one hand, and increases the thermal load in particular also due to the uneven distribution along the circumference of incident light, on the other hand.

It is the object of the invention to provide a flash lamp which can be produced easily and which is particularly well suited for U.V. applications.

The invention comprises several aspects which can be used as such but in particularly advantageous manner also in combination, namely:

A. A flash lamp is described which emits radiant power predominantly within the U.V. region (wavelengths <450 nm) and whose energy per flash is below 100 Ws, preferably below 50 Ws.

B. A low-melting glass having good U.V. transmission is used for the body of the flash lamp in connection with a sealing method for the electrodes.

C. An inside diameter is selected for the glass tube, which is larger than the arc diameter during the discharge. This dimensioning is preferred in connection with a one-sided line-like trigger electrode.

D. The trigger electrode is formed by the fold of a reflector, wherein the fold may be a longitudinal fold which may extend in the longitudinal direction of the glass tube and be attached thereto in abutting relationship.

E. The highest possible xenon filling pressure is used.

F. A comparatively high charging voltage is used.

A good U.V. yield of an economically producible flash lamp is obtained by using one or a combination of several of above features groups A to F. As a result, it is possible to reach U.V. light yield regions permitting to influence certain characteristics, in particular of the spectrum, by selecting the glass wall thickness. Contrary to the primary objective of making a glass wall as thin as possible to obtain the least possible absorption, the wall thickness can then be made thicker or the glass material can be chosen freely to obtain certain properties of the flash lamp.

Particularly advantageous combinations are pairings of above features B, C and D (B and C, B and D, C and D) or all of the three features groups together (B, C and D), the resulting flash lamps, where appropriate, in combination with one or both features groups E and F. In this way, it is possible to produce in particular flash lamps according to features group A.

Individual embodiments of the invention are described below with respect to the drawings, in which.

Quite generally the invention is in the creation of a flash lamp which emits over 30%, preferably over 50%, more preferably over 70%, of its radiant power within the U.V. region (wavelengths <450 nm) and whose energy per flash is below 100 Ws, preferably below 50 Ws, more preferably below 20 Ws. The energy per flash may be above 1 or 2 Ws. As a result, flash lamps are created which are suited for the domestic field, e.g. to disinfect objects.

Figure 1:
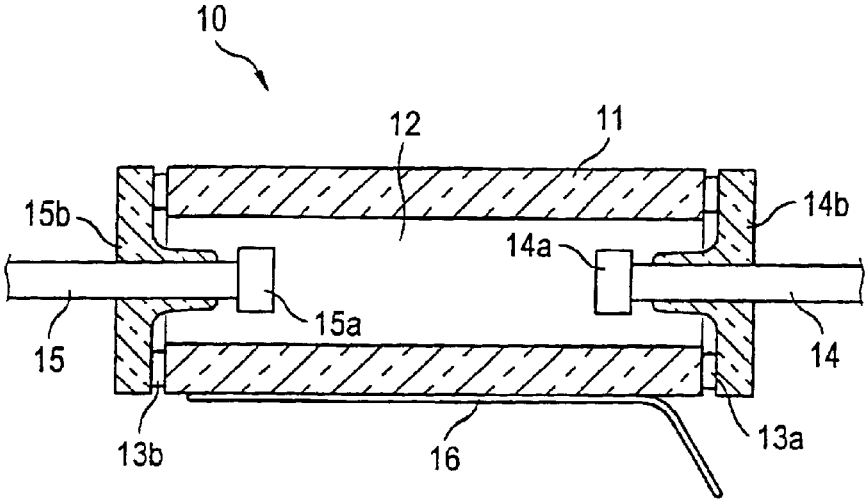
FIG. 1 shows a flash lamp according to the invention.

The flash lamp may be designed as shown in FIG. 1. FIG. 1 shows a diagram of a flash lamp 10 in longitudinal section. 11 refers to the glass body of the flash lamp. It is preferably oblong as well as round and cylindrical. Electrodes 14 and 15 which may be fused into the glass body 11 in a way to be described in more detail below are located at the longitudinal ends of the flash lamp. Electrodes 14, 15 comprise anode 14*a* and cathode 15*a*. A starting electrode 16 is provided outside the interior space 12 of the flash lamp. It may have a conventional design or a design according to the invention which is to be described below. The starting electrode preferably extends longitudinally in the longitudinal direction of the flash lamp. In particular, it covers preferably the focal length of the flash lamp (i.e. the area between electrode plates 15*a*, 14*a*).

The glass of the tubular body 11 has good U.V. transmission. It can be described as follows:

It has a low content of polyvalent ions, in particular of iron. The content is below 30%, in particular below 10%, of the value of glasses used for conventional flash lamps (photographic flash lamps). The same can apply as regards the oxides of aluminum and generally of alkali and alkaline earth metals.

As to the U.V. transmission the glass may be described on the basis of its transmission values Tw at certain wavelengths as follows: at 180 nm, Tw is greater than 5%, preferably greater than 9%, at 200 nm, Tw is greater than 30%, preferably greater than 45%, at 254 nm (mercury line), Tw is greater than 60%, preferably greater than 80%. A glass which meets the above transmission values is glass 8337B of Schott company, which according to the manufacturer's statements has a transmission value of 10% at 180 nm, a transmission value of 50% at 200 nm and a transmission value of 90% at 254 nm. The statements made on Tw in this description and in the claims are meant to be constants of the material in the sense that they refer to glasses having a thickness of 0.5 mm. In fact, actually built flash lamps may have different transmission values because of the wall thickness thereof, in particular they may have lower values in the case of thicker glasses and higher values in the case of thinner glasses.

The glass used meets one or more of the above mentioned conditions as regards U.V. transmission and/or the composition of the materials. The more difficult processing involved can be compensated by fusing electrodes 14 and 15 or electrode designs 14, 14*a*, 14*b* and 15, 15*a* and 15*b* to the glass body 11 by means of glass solder 13*a*, 13*b*. Electrodes 14 and 15 preferably include, or consist of, tungsten. The oblong pins 14, 15 piercing through glass body 11 may be surrounded by glass solder 13*a*, 13*b* in the area of passage through glass body 11 (not shown). The glass solder in turn is fused to glass body 11 which is composed as described above and/or has the above properties. In addition, a sealing ring (not shown) can be provided between glass solder 13*a*, 13*b* and glass body 11, which ring is also made of glass. Electrodes 14 and/or 15 may also be embedded in a glass plate 14*a*, 15*b* as shown in FIG. 1. The glass plate may be attached to glass body 11 by means of glass solder 13. With a suitable diameter of glass plate 14*b*, 15*b* the attachment may be made, as shown, to the cylindrical circumference of the glass tube 11.

(Differently from what is shown) anode 14*a* may be a simple extension of the tungsten wire. The cathode 15 may have a sleeve over the tungsten wire, which contains tungsten and/or nickel and/or niobium and/or tantalum and/or titanium.

As regards its hardness glass solder 13 has a temperature characteristic with a very low temperature. In particular, it is several 10° C. below that of the already low-melting glass of glass body 11 (in particular e.g. as regards softening point and transformation point). The corresponding temperatures of the glass solder may be at least 60 or 80° C. below those of the glass of body 11. The glass solder also has a coefficient of thermal expansion which is closer to that of the tungsten wire than to that of the glass of body 11. The same applies as regards the temperature characteristic of the coefficient of thermal expansion, in particular within the range between room temperature, processing temperature and operating temperature.

By bringing the coefficient of thermal expansion of glass solder 13 into line with that of metal pins 14, 15, the transition between metal and glass is comparatively insensitive to cracks and leakages, which can occur in particular on account of alternating loads based on changing temperatures as the lifetime of a lamp proceeds or initially during the production thereof. The connection between glass solder 13 and glass body 11 is particularly intimate due to the similar materials, thus also being satisfactory. The low-temperature processing of the glass solder permits an operating cycle gentle for the also low-melting glass of body 11.

Figure 2A:
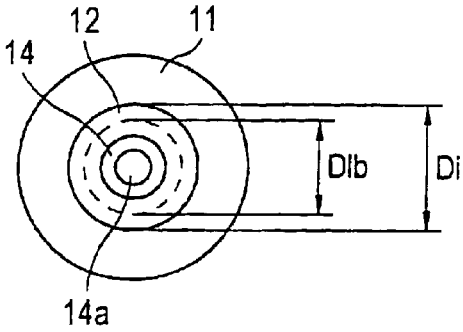
FIGS. 2A to 2B shows the dimensions and definitions for a flash lamp.
Figure 2B:
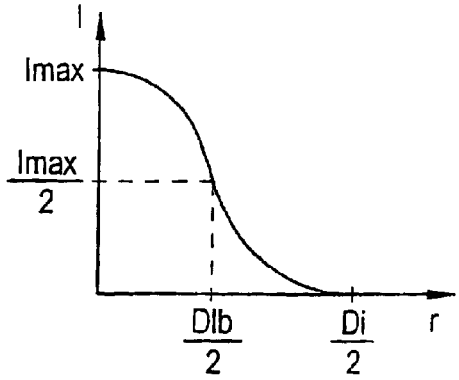

FIG. 2 shows preferred dimensioning features which as such or in combination with the above features lead to particularly good flash lamps. FIG. 2A shows a flash lamp 11 in cross-section. 12 is the interior space of the flash lamp. 13*a* symbolizes the glass solder, and 14*a* is the front face of the electrode. Di is the inside diameter of the cylindrical glass tube. Dlb represents the diameter of the arc resulting when the arc has been established between electrodes 14 and 15. Since the arc is not necessarily defined strictly as regards space, the radius at which the emission intensity has dropped to half the maximum value may be used as a criterion for the arc diameter. This is outlined in FIG. 2B. This figure shows the emission intensity I against radius r. In the example, it is assumed that radius r=ø (i.e. in the center of the tube) has maximum intensity Imax. The arc radius (half an arc diameter, Dlb/2) is set by definition where it has dropped to half the maximum value Imax/2.

For the dimensioning instruction for inside diameter Di and arc diameter Dlb it has proved advantageous for Di to be greater than Dlb, in particular when Di>1,2 Dlb or preferably when Di>1.4 Dlb. Such a dimensioning instruction prevents the hot plasma from abutting against the inner wall of the glass so as to reduce the thermal load of the glass of body 11. This has an advantageous effect especially when the glass is a low-melting glass as mentioned above.

Another advantage follows when the ignition (triggered by electrode 16) is effected along a strictly defined line on the inner wall of the glass. This does not mean that the electrode should abut against the inner glass wall. Care should rather be taken that the electric field connected by trigger electrode 16 is due to a conductor as point-sized as possible (in the cross-section of FIG. 2A) so that in the vicinity of the trigger electrode the supplied triggering electric field extends radially, at least to some extent. This cannot be achieved by a configuration according to FIG. 5B. A configuration according to FIG. 2A which outlines a line-like trigger electrode 16 on the exterior of body 11 is advantageous. Another embodiment is described below with reference to FIGS. 3A and 3B.

The line-like development of the trigger electrode has the advantage that the material, evaporated during the arc, of the electrodes deposits in a spatially confined manner in the vicinity of the trigger electrode (line-like blackening of the inner glass wall as the lifetime of the flash lamp proceeds). Combined with the above-mentioned diameter dimensions there is the advantage that the once deposited material is less likely removed by the arc again, thus being distributed over the interior space once more.

The trigger electrode is thus preferably designed such that in a sectional drawing it has no remarkable extension in the circumferential direction or in the tangential direction of the flash lamp in so far as it is not spaced from the flash tube. This may be effected by a conventional wire or as described below.

Figure 3A:
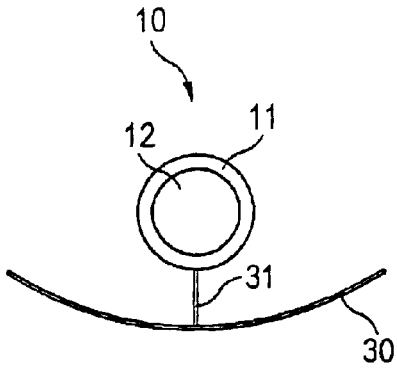
FIGS. 3A to 3B shows an overall design according to the invention.

FIGS. 3A and B show a flash lamp in which the trigger electrode or the starting electrode is formed by part of a reflector sheet. FIG. 3A shows an embodiment in which the trigger electrode is formed by a ridge 31 mounted on the reflector 30. At least the ridge 31 is made of metallic material or metallized. The reflector 30 itself may be metallic or non-metallic. In this case, ridge 31 should be included in the wiring of the flash lamp as a starting electrode 16 and wired correspondingly.

Figure 3B:
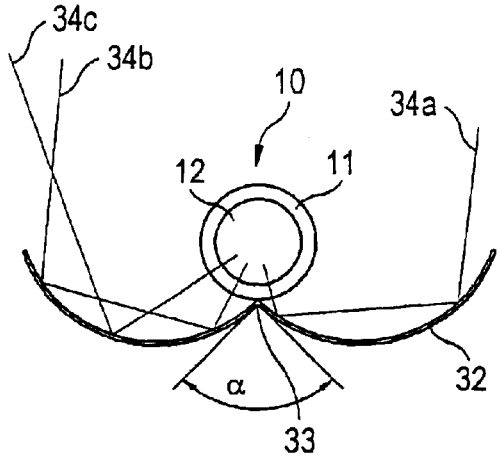

A further embodiment is shown in FIG. 3B. Here, the reflector 32 is formed as a folded sheet. The fold 33 in reflector sheet 32 is oblong and extends preferably along the longitudinal direction of flash lamp 10, preferably it abuts against body 11 of flash lamp 10 (in the installed condition). In this case, the reflector 32, in turn, should be incorporated into the wiring of the flash lamp and be wired suitably. Where necessary, it has to be kept in an insulated fashion.

The shape of the reflector 32 may be axisymmetric, viewed in the section of FIG. 3B. The reflector may have two, preferably symmetric concave halves which abut against each other along fold 33. The cross-sectional shape may be that of a "W", wherein the shapes other than fold 33 may be rounded suitably in the center. The interior angle $\alpha$ at fold 33 may be 120° or less, preferably 90' or less, more preferably 60° or less. The reflector halves may be shaped with respect to desired scattering and focusing properties of the overall design.

The reflector design described with respect to FIG. 3B also serves for avoiding multiple reflections, since light emitted to the rear side (in FIG. 3B below) is not reflected back to the glass body 11 of flash lamp 10 but reflected transversely away therefrom and then to the front, which is outlined in FIG. 3B by some optical paths 34*a, b, c*. As a result, the special thermal load of the rear wall of tube 11 is largely avoided. This reduces unsymmetrical thermal expansions and reduces the heating of the flash tube, especially in the region where due to the selected starting electrode design evaporated material deposits on the inner side. On account of the lowered temperatures, the once deposited material has less tendency to evaporate again and deposit elsewhere.

Furthermore, the light efficiency is improved by avoiding multiple reflections since in the very glass of tube 11 U.V. radiation is absorbed with particular intensity. When there was only one back-reflection (originally out, then back again and finally out again), the coefficient of absorption of the glass would be three times as efficient, so that the corresponding light was lost with respect to the yield, on the one hand, and contributed to the undesired heating of the glass, on the other hand.

A reflector like that described with respect to FIGS. 3A and B is considered to be an independent and, where appropriate, separately claimed part of the invention.

Figure 4:
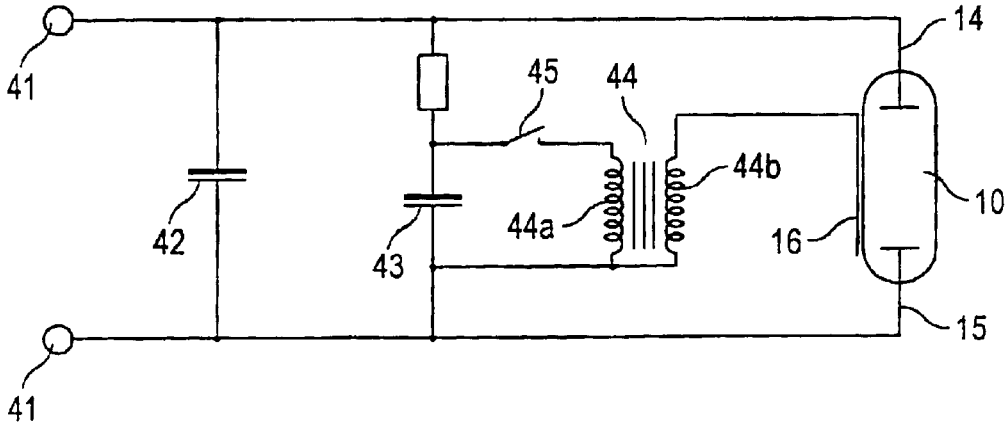
FIG. 4 shows a circuit for a flash lamp.

FIG. 4 shows a flash lamp design. It has a flash lamp 10 which may comprise the above described features. A capacitor 42 serves for receiving electric energy which shall supply primarily the flash process. The energy may be taken from an optionally transformed and rectified alternating voltage which then charges the capacitor 42 through connections 41. The energy may also be supplied by a battery. In this case, a suitable higher direct voltage for charging the capacity would be produced via a chopper and coil/transformer and applied to terminals 41. The capacitor 42 is preferably an electrolytic capacitor.

Its terminals are connected to terminals 14 and 15 of flash lamp 10 so that the capacitor voltage is available at the terminals thereof.

Another small capacitor 43 serves for producing the starting voltage. It is also charged. It is short-circuited by actuating the switch 45. The change in current and/or voltage resulting from this in the primary coil 42*a* of a transformer 44 has alternating current portions which are stepped up by a suitably dimensioned transformer 44. Its secondary coil 44*b* is connected to the starting electrode 16 (e.g. according to FIG. 3) of the flash lamp.

Thus, switch 45 serves for firing the flash. It may be an electrically, electronically or manually actuated switch. The starting voltage is only required for firing the flash. Correspondingly, capacitor 43 may also have relatively small dimensions. Once flash lamp 10 has fired (by applying the starting voltage to the starting electrode 16), the ohmic resistance of flash lamp 10 will drop significantly on account of the resulting plasma so that the capacitor voltage of flash capacity 42 as such suffices to keep the discharge going. The discharge may die away (capacitor 42 partially empty) or be actively stopped by suitable wiring structures (not shown).

The flash capacitor is designed for a charging voltage/operating voltage of above 370 volts, preferably above 400 volts, and below 450 volts, preferably below 430 volts. A comparatively high operating voltage causes a comparatively high discharge current which by the way is superproportionally high on account of the non-linearity of the plasma. Due to this a comparatively hot plasma results which emits a lot of energy in particular within the U.V. region. Corresponding to formula $E=0.5\ CU^2$ (E=energy in the capacitor, C=capacitance, U=voltage) it is also possible to select a smaller flash capacitor with equal flash energy. Furthermore, a comparatively "small" flash capacitance 42 is advantageous also because in this case the time constant t for the discharge (t=R*C42) becomes small so that the discharge duration is short, the temperature is elevated and thus the U.V. portion is higher. Considerations as to economic efficiency of flash capacitor 42 form the upper limit of the selectable voltage (and thus, where appropriate, indirectly the lower limit of the selectable capacitance). Very high capacitor voltages require expensive capacitors so that an upper limit of 450 or 430 volts charging voltage may appear useful. The capacitance of the flash capacitor is preferably below 500 pF, more preferably below 300 $\mu$F.

Another possibility of increasing the U.V. yield is to increase the filling pressure in the flash lamp 10, in particular the xenon filling pressure. By raising the filling pressure, the plasma channel during the flash becomes narrower without the peak current and thus the flash power and flash energy being markedly reduced. By narrowing the plasma channel, the plasma becomes hotter so that more energy is emitted within the ultraviolet region. An increased xenon filling pressure, however, also raises the necessary starting voltage at starting electrode 16. Since this voltage cannot be raised as desired because flash-overs should be avoided, the starting conditions also set a limit to the xenon filling pressure. The xenon filling pressure may be above 0.5 bar, preferably above 1.5 bars, more preferably above 2 bars.

If several of the above described features are combined, comparatively high U.V. yields may result. They may be so high that it is ultimately possible to use absorption parameters as to the glass of body 11 of the flash lamp for adjusting certain properties of the flash lamp. For example, the thickness of the glass wall may finally be selected such that it is thicker than should be with respect to mechanical stability, and also as regards thermal voltage load, to obtain certain spectra and/or distributions.

Typical dimensions and data of a flash lamp may be as follows:

inside diameter Di between 3 and 6.5 mm, typically between 4.5 and 5.5 mm focal length (distance between electrodes 14*a* and 15*a*) between 15 and 25 mm, typically 18 to 22 mm, glass wall thickness 0.2 to 0.8 mm, typically 0.4 to 0.6 mm, xenon filling pressure 0.5 to 5.5 bar, typically 1.5 to 4.5 bar, capacitance of flash capacitor 100 to 300 $\mu$F, preferably 150 to 250 $\mu$F, energy per flash between 5 and 17 Ws, preferably between 10 and 15 Ws.

What is claimed is:

1. A flash lamp (10) comprising a gas-filled discharge tube (11) made of glass and, at each end, a power electrode (14, 15), characterized in that a glass is used which with a thickness of 0.5 mm has one or more of the following transmission parameters Tw:

at 180 nm: Tw>5%, preferably >9% at 200 nm: Tw>30%, preferably >45%, at 254 nm: Tw>60%, preferably >80%, and further characterized in that at least one power electrode (14, 15) is connected with the discharge tube by means of glass solder **(13*a*, 13*b*), the glass solder having a softening point and/or a transformation point which is at least 60° C. below the respective one of the glass of discharge tube (11)**.

2. The flash lamp (10) according to claim 1 wherein the power electrodes (14, 15) at the ends of tube (10) are capable of establishing an arc therebetween and further comprising a starting electrode (16), characterized in that the inside diameter of the discharge tube (11) is larger than 1.2 times a diameter of the arc established between the power electrodes (14, 15).

3. The flash lamp (10) according to claim 2, characterized in that the inside diameter of the discharge tube (10) is larger than 1.4 times the diameter of the arc established between the power electrodes (14, 15).

4. The flash lamp (10) according to claim 2 or 3, characterized in that the starting electrode (16) has no remarkable extension in the peripheral or tangential direction of the discharge tube (11).

5. The flash lamp (10) according to claim 1 further comprising a starting electrode (16) and a reflector (30-33), characterized in that the starting electrode (16) is part of the reflector (30-33) or is electrically connected thereto.

6. The flash lamp (10) according to claim 5, characterized in that the starting electrode (16) is formed by a fold (33) in the reflector sheet (32).

7. The flash lamp according to claim 6, characterized in that the reflector has two halves abutting against each other at fold (33).

8. The flash lamp (10) according to claim 6 or 7, characterized in that fold (33) extends in the longitudinal direction of flash lamp (10).

9. The flash lamp (10) according to claim 1 comprising a gas filling including xenon within the discharge tube (11), characterized in that the xenon filling pressure is greater than 0.5 bar, preferably greater then 1.5 bars.

10. The flash lamp (10) according to claim 9, characterized in that the filling pressure is below 4.5 bars.

11. The flash lamp (10) according to claim 1 further comprising a flash capacitor (42) associated therewith, characterized in that the flash capacitor (42) is designed for a charging voltage of greater than 370 volts, preferably greater than 400 volts.

12. The flash lamp (10) according to claim 11, characterized in that flash capacitor (42) is designed for a charging voltage of below 450 volts, preferably below 430 volts.

13. The flash lamp (10) according to claim 11 or 12, characterized in that the capacity of flash capacitor (42) is below 300 $\mu$F.

14. The flash lamp (10) according to claim 1 characterized in that a wall thickness of the discharge tube (11) is thicker than a value selected with respect to mechanical and thermal stability.

15. The flash lamp (10) according to claim 14, characterized in that the wall thickness of the discharge tube (11) is selected such that a certain absorption behavior results at a certain wavelength or within a certain wavelength region.

16. A flash lamp (10) according to claim 1 which emits radiant power predominantly within the U.V. region (wavelengths <450 nm, preferably <350 nm).

17. The flesh lamp (10) according to claim 1 whose energy per flash is below 100 Ws, preferably below 50 Ws, more preferably below 20 Ws.

18. The flash lamp (10) according to claim 5 comprising a gas filling including xenon within the discharge tube (11), characterized in that the xenon filling pressure is greater than 0.5 bar, preferably greater than 1.5 bars.

19. The flash lamp (10) according to claim 5, characterized in that the filling pressure is below 4.5 bars.

20. A flash lamp (10) according to claim 5 which emits radiant power predominantly within the U.V. region (wavelengths <450 nm, preferably <350 nm).

21. A flash lamp (10) according to claim 11 which emits radiant power predominantly within the U.V. region (wavelengths <450 nm, preferably <350 nm).

22. A flash lamp (10) according to claim 14 which emits radiant power predominantly within the U.V. region (wavelengths <450 nm, preferably <350 nm).

23. The flash lamp (10) according to claim 5 whose energy per flash is below 100 Ws, preferably below 50 Ws, more preferably below 20 Ws.

24. The flash lamp (10) according to claim 11 whose energy per flash is below 100 Ws, preferably below 50 Ws, more preferably below 20 Ws.

25. The flash lamp (10) according to claim 14 whose energy per flash is below 100 Ws, preferably below 50 Ws, more preferably below 20 Ws.

* * * * *

UNITED STATES PATENT AND TRADEMARK OFFICE

CERTIFICATE OF CORRECTION

PATENT NO. : 6,867,547 B2
DATED : March 15, 2005
INVENTOR(S) : Ingo Dunisch

Figure 5A:
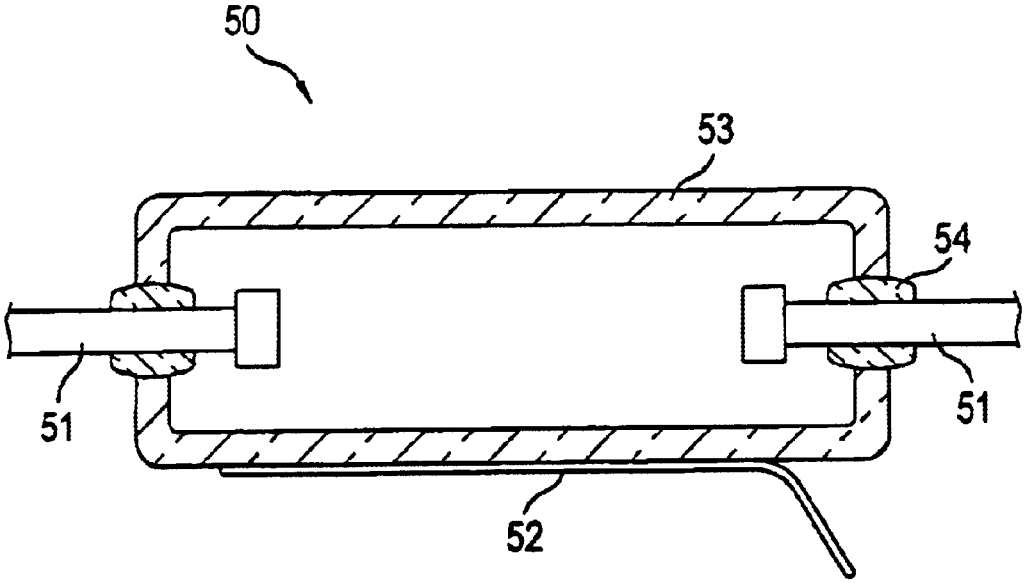
FIG.5A PRIOR ART
FIGS. 5A to 5B shows known embodiments.
Figure 5B:
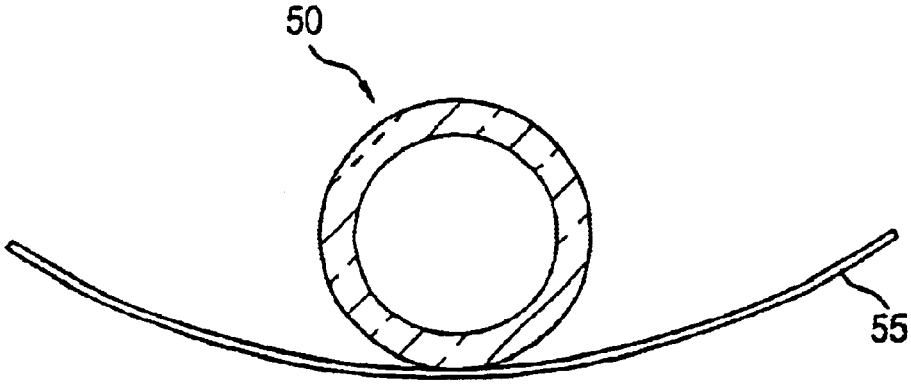
FIG.5B PRIOR ART

It is certified that error appears in the above-identified patent and that said Letters Patent is hereby corrected as shown below:

Column 2,
Line 42, change "FIGS. 2A to 2B shows" to -- FIGS. 2A to 2B show --.
Line 44, change "FIGS. 3A to 3B shows" to -- FIGS. 3A to 3B show --.
Line 47, change "FIGS. 5A to 5B shows" to -- FIGS. 5A to 5B show --.

Column 5,
Line 22, change "preferably 90' or less, more" to -- preferably 90° or less, more --.

Column 6,
Line 39, change "preferably below 500 pF, more" to -- preferably below 500 $\mu$F, more --.

Column 8,
Line 27, change "The flesh lamp (10)" to -- The flash lamp (10) --.

Signed and Sealed this

Ninth Day of August, 2005

JON W. DUDAS
*Director of the United States Patent and Trademark Office*